US006647654B2

(12) United States Patent
Iten et al.

(10) Patent No.: US 6,647,654 B2
(45) Date of Patent: Nov. 18, 2003

(54) REVOLVER CYLINDER CONFIGURED TO ACCOMMODATE BLANKS AND METHOD FOR SIMULATING FIREARM OPERATION

(75) Inventors: Mike Iten, Havre De Grace, MD (US); Chris Harrison, Marriotsville, MD (US); Stephen P. Rosa, Ellicott City, MD (US); Motti Shechter, Potomac, MD (US)

(73) Assignee: Beamhit, LLC, Columbia, MD (US)

( * ) Notice: Subject to any disclaimer, the term of this patent is extended or adjusted under 35 U.S.C. 154(b) by 0 days.

(21) Appl. No.: 10/043,892

(22) Filed: Jan. 10, 2002

(65) Prior Publication Data

US 2002/0116855 A1 Aug. 29, 2002

Related U.S. Application Data

(60) Provisional application No. 60/260,386, filed on Jan. 10, 2001.

(51) Int. Cl.[7] ..... F41C 3/14

(52) U.S. Cl. ..... 42/59; 434/21; 434/16

(58) Field of Search ..... 42/58, 59; 434/16, 434/19, 21, 22, 24

(56) References Cited

U.S. PATENT DOCUMENTS

| | | | | |
|---|---|---|---|---|
| 2,855,715 A | * | 10/1958 | Weimer | 42/58 |
| 3,624,946 A | | 12/1971 | Cagnoni | |
| 3,938,262 A | | 2/1976 | Dye et al. | |
| 3,955,301 A | * | 5/1976 | Wiethoff | 42/59 |
| 3,995,376 A | | 12/1976 | Kimble et al. | |
| 3,999,320 A | * | 12/1976 | Zaubzer | 42/58 |
| 4,102,059 A | | 7/1978 | Kimble et al. | |
| 4,313,272 A | | 2/1982 | Matthews | |
| 4,313,273 A | | 2/1982 | Matthews et al. | |
| 4,352,665 A | | 10/1982 | Kimble et al. | |
| 4,367,516 A | | 1/1983 | Jacob | |
| 4,483,088 A | * | 11/1984 | Tussing | 42/1.05 |
| 4,830,617 A | | 5/1989 | Hancox et al. | |
| 4,983,123 A | | 1/1991 | Scott et al. | |
| 5,004,423 A | | 4/1991 | Bertrams | |
| 5,153,375 A | | 10/1992 | Euizabal | |
| 5,220,115 A | * | 6/1993 | Wales et al. | 42/59 |
| 5,344,320 A | | 9/1994 | Inbar et al. | |
| 5,433,134 A | | 7/1995 | Leiter | |
| 5,585,589 A | | 12/1996 | Leiter | |
| 5,740,626 A | | 4/1998 | Schuetz et al. | |
| 5,937,563 A | | 8/1999 | Schuetz et al. | |
| 5,947,738 A | | 9/1999 | Muehle et al. | |
| 6,322,365 B1 | | 11/2001 | Shechter et al. | |

FOREIGN PATENT DOCUMENTS

| | | | |
|---|---|---|---|
| FR | 1 527 299 | | 5/1968 |
| GB | 2 085 559 | | 4/1982 |
| GB | 2110350 A | * | 6/1983 |
| GB | 2 254 403 A | | 7/1992 |
| WO | WO 98/19128 | | 5/1998 |
| WO | WO 99/64810 | | 12/1999 |

* cited by examiner

*Primary Examiner*—Charles T. Jordan
*Assistant Examiner*—John W. Zerr

(57) ABSTRACT

A removable cylinder for a revolver according to the present invention includes a plurality of cartridge chambers, each appropriately sized to receive a blank cartridge therein. The cartridge chambers are sealed at their distal end to prevent debris from a fired blank cartridge from entering the revolver barrel. The cylinder may further include passages (e.g., vent ports or grooves) in communication with the cartridge chambers to vent exhaust gases released from the blank cartridges in response to revolver actuation. The revolver may further include a laser transmitter assembly to project a laser beam toward a target in response to revolver actuation to simulate firearm operation.

40 Claims, 3 Drawing Sheets

REVOLVER CYLINDER CONFIGURED TO ACCOMMODATE BLANKS AND METHOD FOR SIMULATING FIREARM OPERATION

CROSS-REFERENCE TO RELATED APPLICATIONS

This application claims priority from U.S. Provisional Patent Application Serial No. 60/260,386, entitled "Revolver Cylinder Configured to Accommodate Blanks for Simulating Firearm Operation" and filed Jan. 10, 2001. The disclosure of that provisional application is incorporated herein by reference in its entirety.

BACKGROUND OF THE INVENTION

1. Technical Field

The present invention pertains to a cylinder for use with a revolver type firearm. In particular, the present invention pertains to a removable cylinder for a revolver type firearm that is configured to simulate firearm operation (e.g., the sound and "feel" of a revolver). The combination of the cylinder and revolver may additionally be used with a laser transmitter assembly to project a laser beam toward a target upon revolver actuation. The revolver may include any type of laser transmitter and/or be utilized with any type of firearm laser training system, such as those disclosed in U.S. Pat. No. 6,322,365 (Shechter et al) and U.S. patent application Ser. No. 09/761,102, entitled "Firearm Simulation and Gaming System and Method for Operatively Interconnecting a Firearm Peripheral to a Computer System" and filed Jan. 16, 2001; Ser. No. 09/760,610, entitled "Laser Transmitter Assembly Configured For Placement Within a Firing Chamber and Method of Simulating Firearm Operation" and filed Jan. 16, 2001; Ser. No. 09/760,611, entitled "Firearm Laser Training System and Method Employing Modified Blank Cartridges for Simulating Operation of a Firearm" and filed Jan. 16, 2001; Ser. No. 09/761,170, entitled "Firearm Laser Training System and Kit Including a Target Structure Having Sections of Varying Reflectivity for Visually Indicating Simulated Projectile Impact Locations" and filed Jan. 16, 2001; Ser. No. 09/862,187, entitled "Firearm Laser Training System and Method Employing an Actuable Target Assembly" and filed May 21, 2001; and Ser. No. 09/878,786, entitled "Firearm Laser Training System and Method Facilitating Firearm Training With Various Targets and Visual Feedback of Simulated Projectile Impact Locations" and filed Jun. 11, 2001. The disclosures of the above-mentioned patent and patent applications are incorporated herein by reference in their entireties.

2. Discussion of the Related Art

Revolver type firearms are utilized for a variety of purposes (e.g., sporting competition, law enforcement, etc.). The inherent danger associated with these and other firearms necessitates training and practice in order to minimize the risk of injury. However, special facilities are required to facilitate practice of handling and shooting the firearm. These special facilities basically confine projectiles propelled from the firearm within a prescribed space, thereby preventing harm to the surrounding area. Accordingly, firearm trainees are required to travel to the special facilities in order to participate in a training session, while the training sessions themselves may become quite expensive since each session requires new live ammunition for practicing handling and shooting of the firearm. Although blank cartridges may be utilized to overcome the problems associated with firearm projectiles, this type of ammunition typically does not provide any indication of projectile impact. Further, the firearm generally does not discriminate between blank and live ammunition, thereby enabling inadvertent loading of live ammunition during practice with blank cartridges and increasing the risk of severe injury to trainees.

The related art has attempted to overcome the above-mentioned problems by utilizing laser or other light energy with revolver type firearms to simulate firearm operation and/or employing certain features to enhance safety. For example, U.S. Pat. No. 4,102,059 (Kimble et al) discloses a small arms laser training device. A miniaturized laser assembly is mounted on a weapon with the power source and circuitry for the laser assembly being contained within the weapon. The laser revolver or rifle is fired in a normal manner by squeezing the trigger while aiming at the target. The laser emits a harmless invisible signal pulse of coherent light so that if the weapon is aimed correctly a detector indicator unit mounted on the target receives and processes the laser pulse to cause an audible sound signifying that a hit has been registered.

U.S. Pat. No. 4,830,617 (Hancox et al) discloses an apparatus for simulated shooting of small arms, such as a revolver. The apparatus comprises a miniaturized electrical energy source for a radiation emitter which is capable of being accommodated within a dummy cartridge or within the gun barrel. The source can be a capacitor slidably located within the dummy cartridge and which cooperates with a barrel unit housing a switch section, an electronics section and a pulsed infra-red emitter. When the gun is fired, the capacitor is propelled forward by the firing pin until a probe-like switch portion on the capacitor contacts a corresponding switch portion on the barrel unit, thereby actuating the emitter to provide a series of timed pulses that pass through a lens system.

U.S. Pat. No. 5,937,563 (Schuetz et al) discloses a firearms safety system for adapting conventional handheld firearms to fire non-deadly simulated training ammunition. The system provides a series of gas relief ports and passages to prevent the successful firing of live ammunition in the firearm. The system is advantageous for use in handheld firearms, such as pistols and revolvers. In one embodiment, a training revolver, including a smaller-than-standard rifled bore in the barrel, includes a revolver cylinder with a number of cartridge chambers. A pressure relief port is formed in the side of each cartridge chamber and intersects a longitudinal bleed-off channel passing forward to the front end of the cylinder. When a standard live round cartridge is inadvertently placed in the training revolver and fired, the bullet will jam in the rearward end of the barrel and the pressure in the cartridge case will rupture the side of the cartridge and be expelled through the relief port and into the bleed-off channel, thereby exiting harmlessly forward from the cylinder.

The related art systems described above suffer from several disadvantages. In particular, the Kimble et al and Hancox et al systems generally do not include mechanisms to prevent loading of a live round of ammunition. Thus, live ammunition may be inadvertently loaded within the firearm during training, thereby increasing the risk of serious injury. The Schuetz et al system prevents firing of live ammunition, however, the firearms typically employ simulated cartridges that propel non-lethal projectiles. Thus, this system retains the above-discussed dangers and disadvantages associated with shooting projectiles from firearms. Further, the jamming of live ammunition within the barrel of the Shuetz et al system tends to hinder or disrupt performance of simulation activities, especially those requiring rapid and repeated firing of the revolver, since revolver inactivity is required to remove the jammed ammunition.

In addition, the related art systems maintain a passage from the cylinder through the firearm barrel during utilization or firing of blank cartridges. Although blank cartridges are designed to be nonlethal, debris from the cartridge is typically discharged from the barrel and/or cylinder in response to firing and rupture of the blank cartridge. The discharged debris may be dangerous and even deadly, particularly when the revolver is placed in close proximity to and/or aimed at the head or other body part of a person during firing of the revolver.

OBJECTS AND SUMMARY OF THE INVENTION

Accordingly, it is an object of the present invention to provide a firearm simulation system employing a revolver that effectively simulates the "look" and "feel" of real or live ammunition firing conditions while ensuring the safety of persons in proximity to the revolver during the simulated activity.

It is another object of the present invention to prevent the discharge of blank cartridge debris from the revolver barrel or cylinder upon firing of the revolver during the simulated activity.

Yet another object of the present invention is to safely vent pressurized gas released from a ruptured cartridge within a chamber of the revolver cylinder during simulated firing of the revolver.

A still further object of the present invention is to prevent the discharge of live ammunition from the revolver during firearm simulation activities.

The aforesaid objects may be achieved individually and/or in combination, and it is not intended that the present invention be construed as requiring two or more of the objects to be combined unless expressly required by the claims attached hereto.

According to the present invention, a removable cylinder for a revolver includes a plurality of cartridge chambers, each appropriately sized to receive a blank cartridge therein. The cartridge chambers are sealed at their distal end to prevent debris from a fired blank cartridge from entering the revolver barrel. The cylinder may further include passages (e.g., vent ports or grooves) in communication with the cartridge chambers to vent exhaust gases released from the blank cartridges in response to revolver actuation. The revolver may further include a laser transmitter assembly to project a laser beam toward a target in response to revolver actuation to simulate firearm operation.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1A:
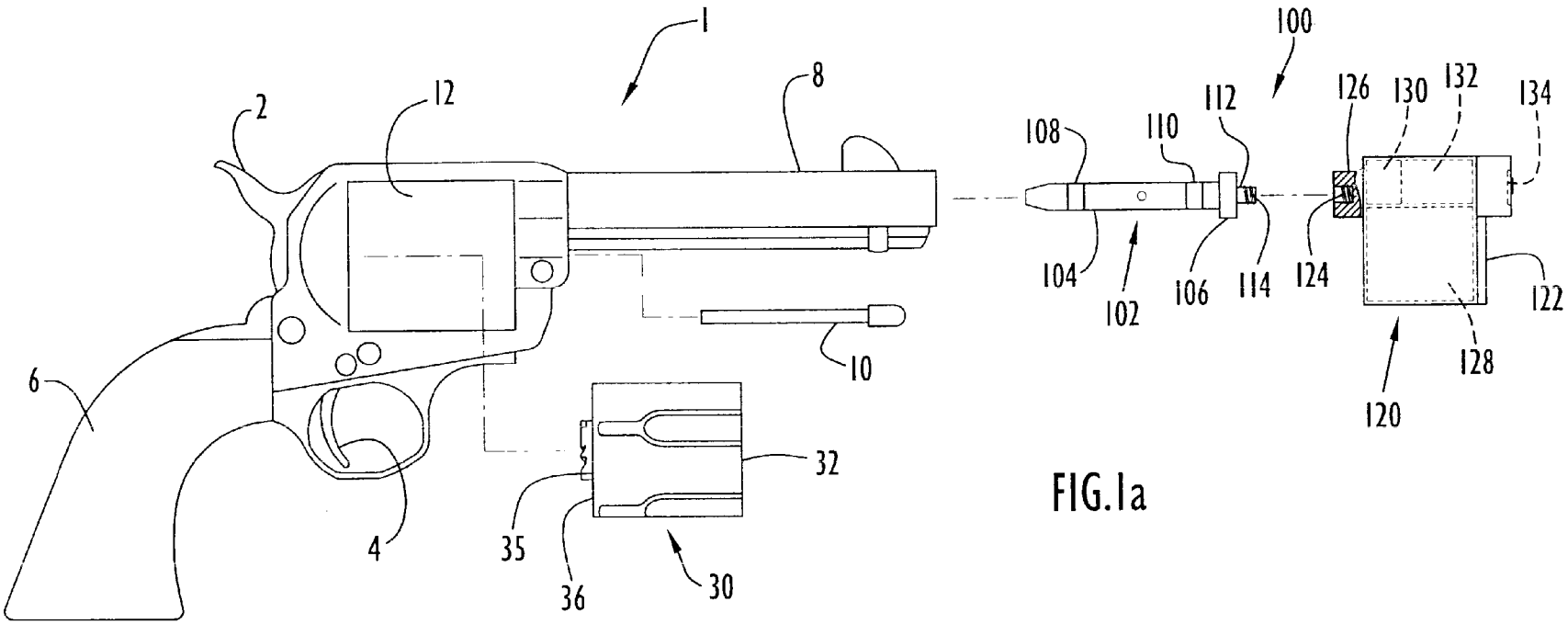
FIG. 1*a* is an exploded side view in partial section of a revolver including a laser transmitter assembly and a removable cylinder to simulate firearm operation according to the present invention.

A revolver including a removable laser transmitter assembly and a removable cylinder configured to accommodate blanks to simulate firearm operation according to the present invention is illustrated in FIG. 1*a*. Specifically, a revolver 1 includes a laser transmitter assembly 100 and a removable cylinder 30 configured to accommodate blank cartridges. Revolver 1 is typically implemented by a conventional six-shot single action revolver utilizing a conventional caliber cartridge (e.g., .38 caliber, .44 caliber, etc.). However, cylinder 30 may be configured for use with any single action, double action or other type revolver utilizing any caliber cartridge. Revolver 1 includes a hammer 2, a trigger 4, a handle or grip 6 and a barrel 8. The revolver further includes a release pin 10 that attaches to the revolver frame beneath barrel 8. The release pin basically secures a cylinder within a cylinder housing portion 12 disposed in the revolver frame between hammer 2 and barrel 8. A cylinder disposed in revolver 1 may be removed via pin 10 and reinserted with cartridges, cleaned and/or exchanged with another cylinder.

The laser transmitter assembly projects a laser beam in response to fall of the hammer against cylinder 30 (e.g., activation of the revolver) to simulate firearm operation. The laser transmitter assembly may be implemented by any conventional or other type of laser transmitter configured to transmit a light beam in response to firing the revolver. An exemplary laser transmitter assembly 100 employed by the revolver includes laser transmitter rod 102 and laser transmitter module 120. Rod 102 includes a generally cylindrical barrel member 104 and a stop 106 disposed at the barrel member distal end. The barrel member is elongated with a tapered proximal end and has transverse cross-sectional dimensions that are slightly less than the cross-sectional dimensions of barrel 8 to enable the barrel member to be inserted within the barrel. However, the barrel member may be of any shape or size to accommodate firearms of various calibers. Adjustable rings 108, 110 are disposed about the barrel member toward its proximal and distal ends, respectively. The dimensions of each ring are adjustable to enable barrel member 104 to snugly fit within and frictionally engage barrel in a secure manner. Stop 106 is in the form of a substantially circular disk having a diameter slightly greater than the cross-sectional dimensions of barrel 8 to permit insertion of rod sections proximal of the stop into the barrel. The stop may alternatively be of any shape or size capable of limiting insertion of the rod into the barrel. Barrel member 104 is connected to the approximate center of a proximal surface of stop 106, while a post 112 is attached to and extends distally for a slight distance from an approximate center of a stop distal surface. Post 112 is substantially cylindrical and has transverse cross-sectional dimensions similar to those of barrel member 104, but may be of any shape or size. The post includes external threads 114 for facilitating engagement with laser module 120 as described below.

Laser module 120 includes a housing 122 including an internally threaded opening 124 defined in a generally cylindrical projection 126 attached to and extending from an upper portion of a housing rear wall. The threaded opening receives post 112 for attaching the laser module to rod 102. The housing, opening and projection may be of any shape or size, while the opening and projection may be disposed at any suitable location. The laser module components are disposed within the housing and include a power source 128, typically in the form of batteries, a mechanical wave sensor 130 and an optics package 132 having a laser (not shown) and a lens 134. These components may be arranged within the housing in any suitable fashion.

The optics package emits a laser beam through lens 134 toward an intended target in response to detection of hammer fall by mechanical wave sensor 130. Specifically, when trigger 4 is actuated, hammer 2 impacts the blank cartridge in a chamber of cylinder 30. The impact and/or cartridge explosion generates a mechanical wave which travels distally along barrel 8 toward rod 102. As used herein, the term "mechanical wave" or "shock wave" refers to an impulse traveling through the revolver barrel. Mechanical wave sensor 130 within the laser module senses the mechanical wave and generates a trigger signal. The mechanical wave sensor may include a piezoelectric element, an accelerometer or a solid state sensor, such as a strain gauge. Optics package 132 within the laser module generates and projects a laser beam from revolver 1 in response to the trigger signal. The optics package laser is generally enabled for a predetermined time interval sufficient for a user to view and/or a target to detect a beam impact. The beam may be modulated, coded or pulsed in any desired fashion. Alternatively, the laser module may include an acoustic sensor to sense actuation of the trigger and enable the optics package. The laser module is similar in function to the laser devices disclosed in the aforementioned patent and patent applications. The laser assembly maybe constructed of any suitable materials and may be fastened to revolver 1 at any suitable locations by any conventional or other fastening techniques.

Figure 1B:
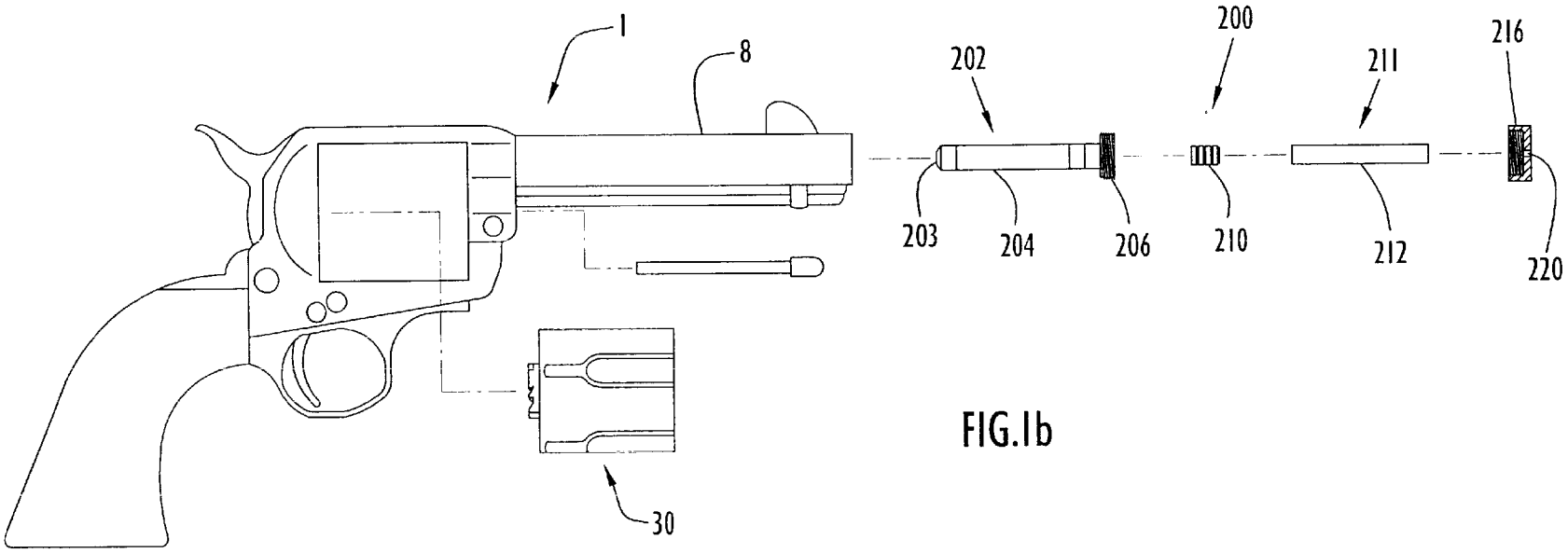
FIG. 1*b* is an exploded side view in partial section of the revolver of FIG. 1*a* including the removable cylinder and an alternative laser transmitter assembly to simulate firearm operation according to the present invention.

An alternative laser transmitter assembly that may be employed by revolver 1 is illustrated in FIG. 1*b*. Initially, revolver 1 and cylinder 30 are substantially similar to the revolver and cylinder described above for FIG. 1*a*. Specifically, laser transmitter assembly 200 includes a barrel sleeve 202, a power source 210, typically in the form of batteries, a laser module 211 and a sleeve cap 216. The barrel sleeve includes a generally cylindrical barrel member 204 and a threaded stop 206 disposed at the barrel member distal end. The transverse cross-sectional dimensions of the barrel member are slightly less than those of the revolver barrel to enable the barrel member to be inserted within the barrel. The barrel member includes an adjustment member 203 disposed at the barrel member proximal end. The adjustment member is typically in the form of a screw and adjusts the barrel member dimensions in response to manipulation by a user. The adjustment member alters the barrel member dimensions to enable the barrel member to frictionally engage the revolver barrel and provide a snug fit. Stop 206 is in the form of a substantially annular ring and has dimensions slightly greater than those of the barrel member and revolver barrel to limit insertion of the sleeve within the revolver barrel. The stop outer surface includes threads facilitating engagement with sleeve cap 216 as described below. Power source 210 has dimensions sufficient for insertion within the barrel sleeve to provide power to laser module 211.

Laser module 211 includes a substantially cylindrical housing 212 including therein a mechanical wave sensor (not shown) and an optics package (not shown) including a laser and a lens, each as described above. The laser module functions in substantially the same manner as laser module 120 described above. The optics package of laser module 211 is generally disposed toward the housing distal end, while the mechanical wave sensor is typically disposed toward the housing proximal end to detect the mechanical wave. Sleeve cap 216 is substantially cylindrical having an open proximal end and a closed distal end. The cap includes threads disposed on its interior surface to engage threads of stop 206. The closed distal end of the cap includes a substantially central opening 220 defined therein to enable a laser beam emitted by the laser module to pass through the cap.

In operation, power source 210 and laser module 211 are inserted into barrel sleeve 202. Sleeve cap 216 is subsequently attached to stop 206 via their respective threaded portions. The barrel sleeve is inserted into the revolver barrel, preferably until stop 206 contacts the barrel distal end. The barrel sleeve dimensions may be selectively adjusted by manipulation of the adjustment member as described above to provide a secure fit. Laser transmitter assembly 200 basically emits a laser beam from laser module 211 through opening 220 of cap 216 in response to revolver actuation in substantially the same manner as laser transmitter assembly 120 described above.

Figure 2:
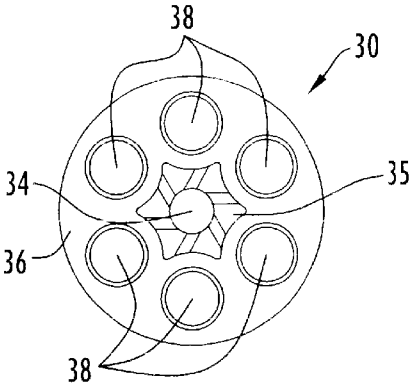
FIG. 2 is an end view in elevation of the removable cylinder according to the present invention.

Referring to FIGS. 1*a* and 2, cylinder 30 has a generally cylindrical configuration dimensioned to fit securely within open housing portion 12 of the revolver. The cylinder is typically made of metal, but may be made of any suitable materials. The exterior surface of cylinder 30 is typically similar to conventional cylinders utilized with revolver 1, and typically includes contoured grooves extending longitudinally along its outer surface so as to maintain the authentic and realistic appearance of the revolver. Cylinder 30 includes a distal end 32, a proximal end 36 and a substantially central cylindrical bore 34 extending longitudinally between both ends and configured to receive release pin 10 of the revolver. The cylinder is disposed within open housing portion 12 of the revolver so that its distal end faces barrel 8 and its proximal end faces hammer 2. Proximal end 36 includes a spindle engaging portion 35 that surrounds bore 34 and has a ratchet surface configured to engage a cylinder spindle (not shown) disposed within the revolver frame between hammer 2 and open housing portion 12. The cylinder spindle engages spindle engaging portion 35 of cylinder 30 in a conventional manner to facilitate rotation of the cylinder about its longitudinal axis to align a cylinder cartridge chamber with the revolver hammer and barrel. When the trigger or hammer of the revolver is actuated, the cylinder spindle rotates cylinder 30 in an appropriate direction, thereby advancing a chamber with a loaded cartridge into position with respect to the hammer and barrel.

The cylinder is secured within the revolver open housing portion via pin 10. The pin is typically inserted into a channel (not shown) that is disposed on the revolver frame below the barrel and extends into the open housing portion. Cylinder 30 is placed in the open housing portion with bore 34 aligned with the channel. Pin 10 is inserted within the channel and passes through the cylinder via the bore to rotatably secure the cylinder within the revolver. Six cartridge chambers 38 are typically defined within cylinder 30, representing a typical cylinder for a .38, .44 or similar caliber revolver. However, the cylinder may include any quantity of cartridge chambers to accommodate various revolver calibers.

Each chamber 38 of cylinder 30 is formed as a substantially cylindrical bore extending in a longitudinal direction from proximal end 36 along a portion of the length of cylinder 30. An opening to each chamber is provided at the proximal end of the cylinder to facilitate loading and unloading of a cartridge into each chamber. The chambers are each spaced circumferentially and substantially symmetrically from each other within the cylinder. Each of the chambers 38 terminate within the cylinder prior to reaching distal end 32, such that the distal end of the cylinder completely seals the chambers and prevents any cartridge remnants or debris from exiting the cylinder at that end. Each chamber typically has dimensions less than the diameter of a corresponding live ammunition cartridge to prevent live ammunition from being inserted into cylinder 30. Consequently, blank cartridges for use with cylinder 30 typically have dimensions less than those of live ammunition cartridges for revolver 1, but sufficient to fit securely within chambers 38. The blank cartridges contain gun powder or other explosive substance so as to simulate the same or similar conditions associated with firing live ammunition from the revolver.

In operation, a live ammunition cylinder disposed within the revolver is initially exchanged with cylinder 30. The live ammunition cylinder is removed from revolver 1 by removing release pin 10 from the revolver frame and disengaging the cylinder from the cylinder spindle in open housing portion 12. Cylinder 30 is positioned within the open housing portion with proximal end 36 facing hammer 2 and spindle engaging portion 35 engaging the cylinder spindle. Pin 10 is inserted into the revolver frame and bore 34 to secure the cylinder within the open housing portion, while allowing the cylinder to rotate during firing. Blank cartridges are typically loaded within chambers 38 of cylinder 30 after the cylinder is placed within the revolver. Upon proper positioning of cylinder 30 within revolver 1, one cartridge chamber of the cylinder is appropriately aligned with the revolver hammer and barrel. Trigger actuation by a user causes hammer 2 to impact the blank cartridge loaded within the aligned chamber. The blank cartridge ruptures or explodes causing a release of pressurized gas that exerts a force on the cartridge in a direction toward the distal end of cylinder 30. However, the cartridge debris cannot advance beyond the cylinder into barrel 8 since the chamber is sealed at distal end 32. Thus, the fired cartridge is safely maintained within the cylinder chamber without debris being propelled from the revolver. The pressurized gas released from the cartridge explosion is forced out of the chamber at the cylinder proximal end and continues toward hammer 2, where the gas dissipates safely from the revolver frame.

Laser transmitter assembly 100 may further be utilized with the revolver and cylinder 30 to simulate projectile impact. In particular, laser module 120 is attached to rod 102 with the rod being subsequently inserted into the revolver barrel, while cylinder 30 containing blank cartridges is disposed in the revolver open housing portion as described above. A user actuates the revolver trigger, thereby causing hammer 2 to impact a blank cartridge within the cylinder chamber. The hammer impact causes the cartridge to rupture or explode with released gases exiting the chamber at the cylinder proximal end as described above. The impact and/or explosion further generates a mechanical wave along the revolver that is detected by laser module 120. The laser module emits a laser beam toward an intended target in response to the mechanical wave as described above. Laser transmitter assembly 200 may alternatively be attached to the revolver as described above and be utilized with cylinder 30 to simulate projectile impact in substantially the same manner described above for laser transmitter assembly 100.

Figure 3:
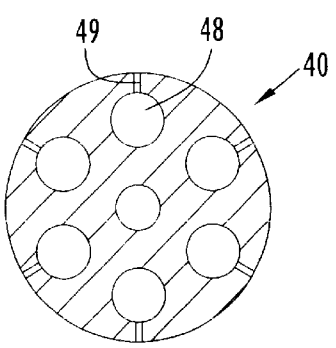
FIG. 3 is an end view in elevation and section of an alternative embodiment of the removable cylinder according to the present invention.

The cylinder of the present invention may further include vents or passages extending from the cartridge chambers to facilitate exhaust of pressurized gas released from fired blanks. Referring to FIG. 3, cylinder 40 is substantially similar to cylinder 30 described above, and further includes exhaust ports extending from the cartridge chambers. In particular, cylinder 40 includes cartridge chambers 48, each substantially similar to cartridge chambers 38 described above, for receiving blank cartridges. Substantially cylindrical exhaust ports 49 each extend radially from a distal portion of a corresponding chamber 48 toward the outer wall or surface of cylinder 40 to provide an exit passage from that cylinder chamber. The dimensions of each exhaust port are significantly less than the corresponding chamber dimensions. Pressurized gas released from a ruptured or exploded cartridge travels from a chamber 48 through a corresponding exhaust port 49. The gas subsequently exits the exhaust port at the outer surface of the cylinder and safely dissipates from the revolver.

Figure 4:
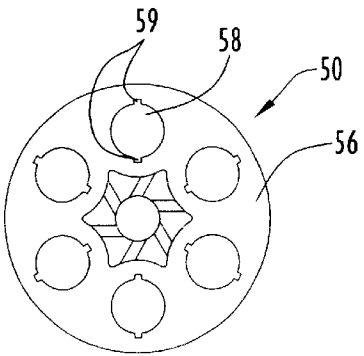
FIG. 4 is an end view in elevation of yet another embodiment of the removable cylinder according to the present invention.

Another embodiment of a cylinder employing exhaust measures is illustrated in FIG. 4. Specifically, cylinder 50 is substantially similar to cylinder 30 described above, and further includes grooves to enable exhaust of pressurized gas from cartridge chambers. In particular, cylinder 50 includes cartridge chambers 58, each substantially similar to chambers 38 described above, for receiving blank cartridges. Grooves 59 are defined in walls of each chamber to assist in the exhaust of pressurized gas toward proximal end 56 of the cylinder. Each chamber preferably includes two grooves angularly spaced approximately one-hundred eighty degrees apart. The grooves generally extend from the chamber proximal end for either a portion or the entire length of the chamber. The chambers may each include any quantity of grooves of any shape or size defined or disposed at any suitable locations within or proximate that chamber. In operation, pressurized gas released from a ruptured or exploded blank cartridge within a cylinder chamber 58 expands into corresponding grooves 59 and flows toward proximal end 56. The gas ultimately exits that cylinder chamber at the cylinder proximal end and dissipates through the revolver frame.

Figure 5:
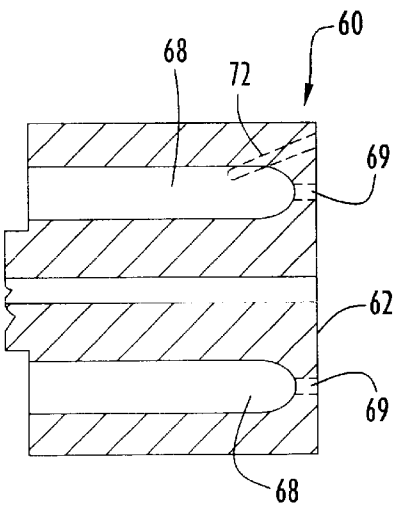
FIG. 5 is a side view in elevation and section of still another embodiment of the removable cylinder according to the present invention.

A further embodiment of a cylinder employing exhaust ports is illustrated in FIG. 5. Specifically, cylinder 60 is substantially similar to cylinder 30 described above, and further includes exhaust ports 69 to exhaust pressurized gas. In particular, cylinder 60 includes chambers 68, each substantially similar to chambers 38 described above, for receiving blank cartridges. Each chamber 68 includes an exhaust port 69 for exhausting pressurized gas from cylinder 60. Each exhaust port 69 extends from the distal end of a corresponding chamber to cylinder distal end 62, and is typically in the form of a cylindrical channel having dimensions less than the diameters of the chamber and blank cartridge. In operation, pressurized gas released from a ruptured or exploded cartridge passes from a chamber 68 into a corresponding exhaust port 69 and exits cylinder distal end 62. Since the chamber is aligned with barrel 8 of revolver 1 during firing of the cartridge, pressurized gas expelled from cylinder distal end 62 passes through the barrel and dissipates in the surrounding environment.

Alternatively, each chamber 68 may include an exhaust port 72 for exhausting pressurized gas from cylinder 60. Each exhaust port 72 extends from a distal portion of a corresponding chamber and is angled in a forward or distal direction to terminate at cylinder distal end 62, generally outside the confines of the barrel. The exhaust ports basically allow gas pressures to subside in a forward direction away from the user and toward the revolver distal end. The exhaust ports preferably extend from the chambers at an angular location of approximately 300 degrees (e.g., as viewed from a chamber proximal end), however, the exhaust ports may be disposed at any locations. Exhaust ports 72 are each typically in the form of a cylindrical channel having dimensions less than the diameters of the corresponding chamber and blank cartridge. In operation, pressurized gas released from a ruptured or exploded cartridge passes from a chamber 68 into a corresponding exhaust port 72 and exits cylinder distal end 62. The pressurized gas is expelled from cylinder distal end 62 in a forward or distal direction away from the user to dissipate in the surrounding environment.

With respect to employment of exhaust channels, particularly exhaust ports extending to the surface of the cylinder (e.g., as illustrated in FIG. 3), the noise level associated with firing a blank cartridge is proportional to the dimensions of each exhaust port or groove. In other words, increasing the dimensions of the exhaust port or groove increases the gas flow and noise level. Thus, cylinders maybe configured with certain dimensioned ports or grooves to achieve a desired noise level. The amount of gun powder or explosive substance within blank cartridges produces a similar effect on the noise level (e.g., the greater the amount of gun powder, the greater the noise level). Accordingly, the amount of gun powder within the blank cartridges may be controlled based upon user requirements relating to the desired sound level during simulated operation of the revolver. The blank cartridges utilized with the revolver are typically free of lead. The system provides a safety measure since the size of a used blank cartridge is completely different than regular or live ammunition.

The revolver may utilize any of the cylinders described above for FIGS. 3–5 in substantially the same manner described above for cylinder 30, where released gases exit the cylinder chambers via the corresponding exhaust ports or grooves. The revolver may further utilize any of the above-described cylinders with or without employment of a laser transmitter assembly. The combination of the cylinder and a laser transmitter assembly with the revolver allows for the safe implementation of many different simulation or training activities that provide both a measurement of user accuracy as well as the sound and "feel" associated with firing live rounds of ammunition.

It will be appreciated that the embodiments described above and illustrated in the drawings represent only a few of the many ways of implementing a revolver cylinder configured to accommodate blanks and method for simulating firearm operation.

The cylinders of the present invention may be utilized with any single action, double action or other type revolver or any firearm employing a cylinder. Further, the cylinders may be utilized with a replica firearm employing blanks. The cylinders may be of any size, shape or color and may be constructed of any suitable materials (e.g., metal, plastic, etc.). The cylinders may employ any particular color (e.g., blue) to clearly identify that those cylinders employ and retain blanks. The cylinders may include any quantity of cartridge chambers (e.g., one cartridge chamber) of any shape or size and disposed at any suitable locations to accommodate any caliber blanks or rounds for any type of revolver or other firearm. The bores of the respective cylinders may be of any quantity, size or shape, and may be defined in the cylinders at any desired locations. Similarly, the release pin may be of any quantity, size or shape for insertion within the bores of the respective cylinders.

The cartridge chambers of the cylinders may have any geometrical shape in cross-section (e.g., circular, rectangular, etc.) for receiving blank cartridges with complimentary sizes and shapes. The cartridge chambers may be utilized with or without exhaust passages. The cartridge chambers may extend along any length of the cylinders and terminate at any distance from the respective distal walls of those cylinders. The cylinders may alternatively be adapted to utilize cartridges with live ammunition.

The blank cartridges utilized within the cylinders may be of any size or shape. The cartridges are preferably constructed of lead-free materials, but may be constructed of any suitable materials. The cartridges may include any quantity of any conventional or other explosive or pressurized substances sufficient to generate a desired sound level and/or "feel" of the revolver as it is fired, but preferably include a quantity less than the quantities utilized for live rounds.

The exhaust ports and grooves may be of any quantity, shape or size, may be disposed at any suitable locations along a chamber, and may be of any suitable length. The exhaust ports and grooves may also be sized with any suitable dimensions to achieve any desired noise level. The exhaust ports and grooves may be associated with any quantity of cartridge chambers within the cylinders. The cartridge chambers may each include any quantity of grooves and/or exhaust ports either individually or in any desired combination. The grooves and exhaust ports may extend in any desired path (e.g., straight, serpentine, zig-zag, winding, radial, etc.) and/or at any desired angles within the cylinders. Exhaust ports may extend from a cartridge chamber to any location on the outer surface of the cylinder. Exhaust ports and grooves may intersect, converge or branch with any other exhaust ports and/or grooves to provide one or more exits from the cartridge chambers. In effect, the exhaust ports and/or grooves for use in the cylinders of the present invention may include any configurations to facilitate the exhausting of pressurized gas from the ruptured or exploded cartridges at any one or more locations on any outer surface of the cylinders.

The laser assemblies may be utilized with any type of targets (e.g., targets visibly reflecting the beam, including detectors to detect the beam, etc.), firearms and/or firearm laser training systems, such as those disclosed in the aforementioned patent and patent applications. The laser modules may be fastened to the revolver at any suitable location via any conventional or other fastening techniques (e.g., frictional engagement with the barrel, brackets attaching the device to the revolver, etc.). Further, the assemblies may include replaceable revolver components (e.g., a barrel) including a laser device disposed therein for firearm training. The laser assemblies may emit any type of laser beam within suitable safety tolerances. The housings of the laser modules may be of any shape or size, and may be constructed of any suitable materials. The opening of the laser assembly employing the rod may be defined in the associated laser module housing at any suitable locations to receive the rod. Alternatively, the rod and associated housing may include any conventional or other fastening devices (e.g., threaded attachment, hook and fastener, frictional engagement with the opening, etc.) to attach the module to the rod. The optics package of the respective laser assemblies may include any suitable lens for projecting the beam, while the laser beam may be enabled for any desired duration. The laser assemblies may be fastened to a revolver at any suitable locations (e.g., external or internal of a barrel) and be actuated by a trigger or any other device (e.g., power switch, firing pin, relay, etc.). Moreover, the respective laser modules may be configured in the form of ammunition for insertion into a firearm firing or similar chamber and project a laser beam in response to trigger actuation. Alternatively, the respective laser modules may be configured for direct insertion into the barrel without the need for the rod or sleeve.

The respective laser modules may include any type of sensor or detector (e.g., acoustic sensor, piezoelectric element, accelerometer, solid state sensors, strain gauge, etc.) to detect mechanical or acoustical waves or other conditions signifying trigger actuation. The components of the laser assemblies may be arranged within the respective module housings in any fashion, while the power sources of the respective laser assemblies may be implemented by any type or quantity of batteries or other power sources. Alternatively, the laser assemblies may include a power adapter for receiving power from a common wall outlet jack or other power source. The laser beam emitted by the laser assemblies may be visible or invisible (e.g., infrared), may be of any color or power level, may have a pulse of any desired duration and may be modulated in any fashion (e.g., at any desired frequency or unmodulated) or encoded in any manner to provide any desired information, while the respective transmitters may project a beam continuously or include a "constant on" mode. The revolver maybe utilized with transmitters and detectors emitting any type of energy (e.g., light, infrared, etc.).

The laser transmitter rod may be of any shape or size, and may be constructed of any suitable materials. The rod may include dimensions to accommodate any firearm caliber. The rings may be of any shape, size or quantity and may be constructed of any suitable materials. The rings may be disposed at any locations along the rod and may be implemented by any devices having adjustable dimensions. The stop maybe of any shape or size, maybe disposed at any suitable locations along the rod and may be constructed of any suitable materials. The post may be of any shape or size, may be disposed at any suitable locations on the rod, and may be constructed of any suitable materials. The post or rod may include any conventional or other fastening devices to attach the associated laser module to the rod. The barrel sleeve, barrel member and stop maybe of any shape or size, and maybe constructed of any suitable materials. The barrel sleeve may include dimensions to accommodate any firearm caliber. The barrel sleeve cap may be of any shape or size, and may be constructed of any suitable materials. The sleeve may engage the sleeve cap in any suitable manner. The cap opening maybe of any quantity, shape or size and maybe defined at any suitable locations. The sleeve may include any type of adjustment mechanism to facilitate adjustment of barrel sleeve dimensions to provide a secure fit within a firearm barrel.

It is to be understood that the terms "top", "bottom", "upper", "lower", "side", "front", "forward", "rear", "height", "length", "width", "horizontal", "vertical" and the like are used herein merely to describe points of reference and do not limit the present invention to any particular orientation or configuration.

The present invention is not limited to the applications disclosed herein, but may be utilized for any type of firearm training, competition or simulation activities.

From the foregoing description, it will be appreciated that the invention makes available a novel revolver cylinder configured to accommodate blanks and method for simulating firearm operation, wherein a revolver cylinder is configured to accommodate blank cartridges and includes a covered distal end to prevent discharge of cartridge debris. The cylinder may further include exhaust ports or grooves in communication with cylinder chambers to facilitate exhaust of cartridge gases in response to firearm operation.

Having described preferred embodiments of a new and improved revolver cylinder configured to accommodate blanks and method for simulating firearm operation, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A revolver type cylinder for use with a firearm to facilitate simulation of firearm operation comprising:

a housing member removably securable to said firearm and including at least one chamber with an open proximal end to receive a cartridge and a closed distal end to prevent discharge of cartridge debris from said firearm in response to firing of said cartridge;

wherein said at least one chamber includes a passage to exhaust gas expelled from said fired cartridge and said passage includes at least one groove extending from a housing member proximal end along an outer periphery of said at least one chamber to direct said expelled gas within said chamber toward said housing member proximal end.

2. The cylinder of claim 1, wherein said at least one chamber extends distally from a housing member proximal end and terminates proximally of a housing member distal end to form said chamber closed distal end.

3. The cylinder of claim 1, wherein said passage is dimensioned to produce a desired noise level in response to firing of said cartridge.

4. The cylinder of claim 1, wherein said housing member further includes at least one exhaust port extending from said at least one chamber to a housing member exterior surface to exhaust gas expelled from said fired cartridge.

5. The cylinder of claim 4, wherein said at least one exhaust port extends radially from said at least one chamber to said housing member exterior surface.

6. The cylinder of claim 4, wherein said at least one exhaust port extends from said distal end of said at least one chamber to a housing member distal end.

7. The cylinder of claim 1, wherein said at least one chamber is configured to receive blank cartridges for simulating firearm operation and to prevent insertion of live ammunition therein.

8. The cylinder of claim 1, wherein said housing member is color coded to indicate said cylinder accommodates blank cartridges for simulating firearm operation.

9. A revolver type cylinder for use with a firearm to facilitate simulation of firearm operation comprising:

a housing member removably securable to said firearm and including at least one chamber with an open proximal end to receive a cartridge and a closed distal end to prevent discharge of cartridge debris from said firearm in response to firing of said cartridge;

wherein said housing member further includes at least one exhaust port extending from said at least one chamber to a housing member distal end and angled toward said housing member distal end.

10. The cylinder of claim 9, wherein said at least one chamber extends distally from a housing member proximal end and terminates proximally of a housing member distal end to form said chamber closed distal end.

11. The cylinder of claim 9, wherein said at least one chamber is configured to receive blank cartridges for simulating firearm operation and to prevent insertion of live ammunition therein.

12. The cylinder of claim 9, wherein said housing member is color coded to indicate said cylinder accommodates blank cartridges for simulating firearm operation.

13. A firearm configured for simulating firearm operation comprising:

a frame including a handle, a trigger and a barrel; and a revolver type cylinder including a housing member removably securable to said frame and including at least one chamber with an open proximal end to receive a cartridge and a closed distal end to prevent discharge of cartridge debris from said firearm in response to firing of said cartridge;

wherein said at least one chamber includes a passage to exhaust gas expelled from said fired cartridge and said passage includes at least one groove extending from a housing member proximal end along an outer periphery of said at least one chamber to direct said expelled gas within said chamber toward said housing member proximal end.

14. The firearm of claim 13 further including a laser transmitter assembly secured to said firearm to transmit a light beam in response to actuation of said trigger.

15. The firearm of claim 13, wherein said at least one chamber extends distally from a housing member proximal end and terminates proximally of a housing member distal end to form said chamber closed distal end.

16. The firearm of claim 13, wherein and said passage is dimensioned to produce a desired noise level in response to firing of said cartridge.

17. The firearm of claim 13, wherein said housing member further includes at least one exhaust port extending from said at least one chamber to a housing member exterior surface to exhaust gas expelled from said fired cartridge.

18. The firearm of claim 17, wherein said at least one exhaust port extends radially from said at least one chamber to said housing member exterior surface.

19. The firearm of claim 17, wherein said at least one exhaust port extends from said distal end of said at least one chamber to a housing member distal end.

20. The firearm of claim 13, wherein said at least one chamber is configured to receive blank cartridges for simulating firearm operation and to prevent insertion of live ammunition therein.

21. The firearm of claim 13, wherein said housing member is color coded to indicate said cylinder accommodates blank cartridges for simulating firearm operation.

22. A firearm configured for simulating firearm operation comprising:

a frame including a handle, a trigger and a barrel; and a revolver type cylinder including a housing member removably securable to said frame and including at least one chamber with an open proximal end to receive a cartridge and a closed distal end to prevent discharge of cartridge debris from said firearm in response to firing of said cartridge;

wherein said housing member further includes at least one exhaust port extending from said at least one chamber to a housing member distal end and angled toward said housing member distal end.

23. The firearm of claim 22 further including a laser transmitter assembly secured to said firearm to transmit a light beam in response to actuation of said trigger.

24. The firearm of claim 22, wherein said at least one chamber extends distally from a housing member proximal end and terminates proximally of a housing member distal end to form said chamber closed distal end.

25. The firearm of claim 22, wherein said at least one chamber is configured to receive blank cartridges for simulating firearm operation and to prevent insertion of live ammunition therein.

26. The firearm of claim 22, wherein said housing member is color coded to indicate said cylinder accommodates blank cartridges for simulating firearm operation.

27. A method of simulating firearm operation, wherein a firearm includes a frame with an open portion, a trigger and a barrel, said method comprising:

(a) removably receiving a revolver type cylinder in said frame open portion, wherein said cylinder includes a housing member including at least one chamber with an open proximal end to receive a cartridge, a closed distal end and a passage, said passage including at least one groove extending from a housing member proximal end along an outer periphery of said at least one chamber;

(b) facilitating insertion of a cartridge into said at least one chamber for firing by said firearm; and (c) preventing discharge of cartridge debris from said firearm via said chamber closed distal end in response to firing of said cartridge, wherein step (c) further includes:

(c.1) exhausting gas expelled from said fired cartridge by directing said expelled gas within said chamber toward said housing member proximal end via said at least one groove.

28. The method of claim 27, wherein said firearm further includes a laser transmitter assembly secured to said firearm, and said method further includes:

(d) transmitting a light beam via said laser transmitter assembly in response to actuation of said trigger to simulate firearm operation.

29. The method of claim 27, wherein step (a) further includes:

(a.1) forming said chamber closed distal end by extending said at least one chamber distally from a housing member proximal end and terminating that chamber proximally of a housing member distal end.

30. The method of claim 27, wherein said housing member further includes at least one exhaust port extending from said at least one chamber to a housing member exterior surface, and step (c) further includes:

(c.1) exhausting gas expelled from said fired cartridge via said at least one exhaust port.

31. The method of claim 30, wherein said at least one exhaust port extends radially from said at least one chamber to said housing member exterior surface, and step (c.1) further includes:

(c.1.1) exhausting gas expelled from said fired cartridge via said at least one radial exhaust port.

32. The method of claim 30, wherein said at least one exhaust port extends from said distal end of said at least one chamber to a housing member distal end, and step (c.1) further includes:

(c.1.1) exhausting gas expelled from said fired cartridge into said barrel via said at least one exhaust port.

33. The method of claim 27, wherein step (b) further includes:

(b.1) configuring said at least one chamber to include dimensions sufficient to receive blank cartridges for simulating firearm operation and to prevent insertion of live ammunition therein.

34. The method of claim 27, wherein step (a) further includes:

(a.1) color coding said housing member to indicate said cylinder accommodates blank cartridges for simulating firearm operation.

35. A method of simulating firearm operation, wherein a firearm includes a frame with an open portion, a trigger and a barrel, said method comprising:

(a) removably receiving a revolver type cylinder in said frame open portion, wherein said cylinder includes a housing member including at least one chamber with an open proximal end to receive a cartridge, a closed distal end and a passage, wherein step (a) further includes:

(a.1) configuring said passage to include dimensions sufficient to produce a desired noise level in response to firing of said cartridge;

(b) facilitating insertion of a cartridge into said at least one chamber for firing by said firearm; and (c) preventing discharge of cartridge debris from said firearm via said chamber closed distal end in response to firing of said cartridge, wherein step (c) further includes:

(c.1) exhausting gas expelled form said fired cartridge via said passage.

36. A method of simulating firearm operation, wherein a firearm includes a frame open portion, a trigger and a barrel, said method comprising:

(a) removably receiving a revolver type cylinder in said frame open portion, wherein said cylinder includes a housing member including at least one chamber with an open proximal end to receive a cartridge and a closed distal end, said housing member further including at least one exhaust port extending from said at least one chamber to a housing member distal end and angled toward said housing member distal end;

(b) facilitating insertion of a cartridge into said at least one chamber for firing by said firearm; and (c) preventing discharge of cartridge debris from said firearm via said chamber distal end in response to firing of said cartridge, and step (c.1) further includes:

(c.1.1) exhausting gas expelled from said fired cartridge via said at least one angled exhaust port.

37. The method of claim 36, wherein said firearm further includes a laser transmitter assembly secured to said firearm, and said method further includes:

(d) transmitting a light beam via said laser transmitter assembly in response to actuation of said trigger to simulate firearm operation.

38. The method of claim 36, wherein step (a) further includes:

(a.1) forming said chamber closed distal end by extending said at least one chamber distally from a housing member proximal end and terminating that chamber proximally of a housing member distal end.

39. The method of claim 36, wherein step (b) further includes:

(b.1) configuring said at least one chamber to include dimensions sufficient to receive blank cartridges for simulating firearm operation and to prevent insertion of live ammunition therein.

40. The method of claim 36, wherein step (a) further includes:

(a.1) color coding said housing member to indicate said cylinder accommodates blank cartridges for simulating firearm operation.

* * * * *